US008252371B2

(12) United States Patent
Guenard et al.

(10) Patent No.: US 8,252,371 B2
(45) Date of Patent: Aug. 28, 2012

(54) METHOD FOR THE ANTICORROSIVE TREATMENT OF HOLLOW BODIES, METHOD FOR PRODUCING A METALLIC STRUCTURE TREATED ACCORDING TO SAID METHOD, AND METHOD FOR MAINTAINING THE STRUCTURE

(75) Inventors: Thierry Guenard, Romilly sur Seine (FR); Jean-Claude Boulanger, Mesgrigny (FR)

(73) Assignee: Societe Nationale des Chemins de fer Francais, Paris (FR)

( * ) Notice: Subject to any disclaimer, the term of this patent is extended or adjusted under 35 U.S.C. 154(b) by 1051 days.

(21) Appl. No.: 11/916,938

(22) PCT Filed: Jun. 8, 2006

(86) PCT No.: PCT/FR2006/001298

§ 371 (c)(1),
(2), (4) Date: Apr. 8, 2008

(87) PCT Pub. No.: WO2006/131650

PCT Pub. Date: Dec. 14, 2006

(65) Prior Publication Data

US 2008/0199608 A1 Aug. 21, 2008

(30) Foreign Application Priority Data

Jun. 9, 2005 (FR) ..... 05 05848

(51) Int. Cl.
*B05D 7/22* (2006.01)

(52) U.S. Cl. ..... 427/230; 427/140; 427/243; 427/247

(58) Field of Classification Search .... 106/14.05–14.45, 106/15.05, 18.11–18.36; 427/230–236, 238, 427/239, 243, 244, 247, 337, 340, 373, 140
See application file for complete search history.

(56) References Cited

U.S. PATENT DOCUMENTS

| | | | | |
|---|---|---|---|---|
| 3,359,351 | A * | 12/1967 | Bender | 264/46.9 |
| H1976 | H | 8/2001 | Lambrakos et al. | |
| 6,283,215 | B1 * | 9/2001 | Kohler et al. | 166/302 |

FOREIGN PATENT DOCUMENTS

| | | | |
|---|---|---|---|
| DE | 103 35 746 | A1 | 3/2005 |
| GB | 972 405 | A | 10/1964 |
| GB | 972405 | * | 10/1964 |
| GB | 2 185 196 | A | 7/1987 |
| WO | 2006/002496 | A1 | 1/2006 |

OTHER PUBLICATIONS

Machine translation of the specification of DE 10335746, generated Sep. 13, 2011, 2 pages.*
International Preliminary Report on Patentability for PCT/FR2006/001298, issued Dec. 11, 2007, 6 pages.*

* cited by examiner

*Primary Examiner* — William Phillip Fletcher, III
(74) *Attorney, Agent, or Firm* — Novak Druce + Quigg LLP

(57) ABSTRACT

The invention involves the treatment of a hollow body having a difficult-to-access surface to be preserved from corrosion by injecting a cellular foam supporting an anti-corrosion agent into the hollow body. Also involved is the production of a metal structure by assembling the structure and then applying an anti-corrosion treatment to the difficult-to-access surfaces of the structure. The invention is particularly applicable to railway wagons.

8 Claims, 1 Drawing Sheet

METHOD FOR THE ANTICORROSIVE TREATMENT OF HOLLOW BODIES, METHOD FOR PRODUCING A METALLIC STRUCTURE TREATED ACCORDING TO SAID METHOD, AND METHOD FOR MAINTAINING THE STRUCTURE

The invention relates to methods of applying a treatment for protecting hollow bodies or hollow metal structures from corrosion.

BACKGROUND

The metal structures in question here are large structures having surfaces that are difficult to access for depositing an anti-corrosion paint thereon by a brush or gun. They are hollow so as to reduce the weight thereof.

This is in particular the case for the structures such as those used in the construction of the bogies or bodies of railway wagons, which comprise hollow bodies, cross-members, support beams or other sections, supporting the floors or the walls of these wagons. The field of application of the invention is of course not limited to railway transport, it being perfectly possible for any other form of transport or any other field of construction to constitute a field of application of the invention.

It is therefore difficult to protect the inside of these hollow bodies other than by the use of a bent brush or a paint spray tool, such as a specific gun or nozzle, immersion in anti-corrosion coating baths not being possible because of the size of the hollow bodies, before assembly, or of the structures that they reinforce, after assembly.

All the methods at the present time are very expensive as they are very labour-intensive and very lengthy.

BRIEF SUMMARY

It was with the aim of finding a more economic solution that the Applicant had the idea of its invention.

For this purpose, the invention relates to a method of applying an anti-corrosion treatment to a hollow body having a surface that is difficult to access to be preserved from corrosion, which includes at least one step for injecting a cellular foam, supporting an anti-corrosion agent and a fire retardant or a thermal insulator, into the hollow body.

By injection, all the difficult-to-access surfaces that are to be protected are easily reached. These may for example be metal sections or cross-members making up the structures of bodies or subframes that require effective anti-corrosion protection. At the same time, since the cellular foam remains in place after application, these surfaces when they are floors, are covered with a material which is impermeable to water or to cleaning detergents and which contributes to the anti-corrosion protection.

Preferably, a mixture of a first component for expansion of a second component supporting the anti-corrosion agent for producing the anti-corrosion cellular foam and the fire retardant or thermal insulator is injected.

Thus it becomes possible to carry out assembly operations or subsequent dismantling operations, for example by welding, without damaging the anti-corrosion protection of the immediate environment of the zones of the protected structure that are subjected to these operations, or cleaning operations, without any prior dismantling being carried out.

The invention also relates to a process for producing a metal structure, comprising the steps of:

assembly of the structure; and then anti-corrosion protection treatment of the difficult-to-access surfaces of the structure according to the above method.

This method is particularly suitable for the production of the metal structures forming the bodies (which are hollow), the floors or the partitions of railway rolling stock or of boats when at least one of the walls is made of metal and requires a particular anti-corrosion treatment.

Finally, the invention relates to a method of maintenance of a metal structure by replacement of a part of the structure, the structure moreover comprising at least one hollow body protected by a cellular foam according to the method of the invention, and at least one inflammable element separated from the structure part to be replaced by the cellular foam, characterized in that, since the cellular foam is a non-inflammable thermal barrier, said structure part is replaced directly without prior removal of said inflammable element.

BRIEF DESCRIPTION OF THE DRAWINGS

The invention will be more clearly understood with the aid of the following description of the anti-corrosion treatment method according to the invention, with reference to the appended drawing in which.

DETAILED DESCRIPTION

Figure 1:
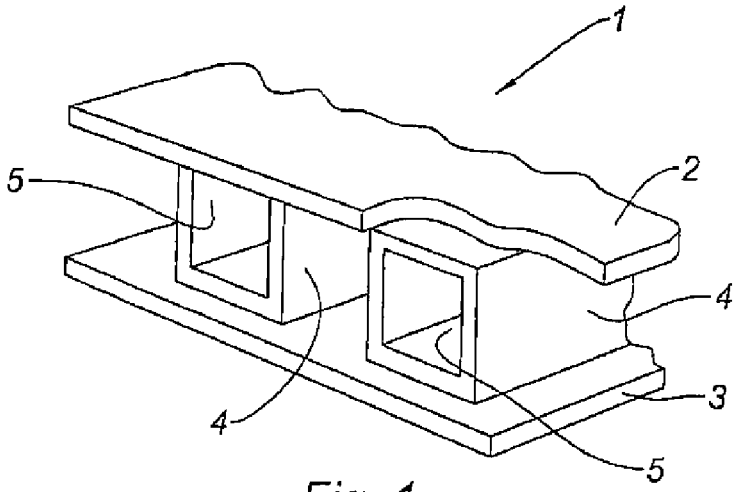
FIG. 1 is a perspective view of a structure having surfaces difficult to access, which have to be protected against corrosion.

Referring to FIG. 1, a structure 1 liable to be subjected to corrosive attack, either by the ambient air or by water, especially when being cleaned using detergents, comprises panels consisting of metal plates 2, 3, or more of such panels, which are joined by metal support beams 4 serving as spacers.

The support beams 4 are hollow and have surfaces 5 that have to be guaranteed to be completely free of any corrosion but are difficult to access with a brush or gun needed to deposit a primer paint.

Since the assembly is constructed by welding, it is not possible to apply a protective coat of paint on the surfaces of the metal plates 2, 3 and on the support beams 4 separately, for example on the one hand using a brush and on the other hand for dipping in a tank of suitable size containing an antioxidant bath, so as to fully immerse the surfaces 5, since the welding operation would locally destroy the protection that has just been applied. Furthermore, the complete structure 1 is too large to be treated in a bath.

The procedure is therefore as follows:

the unprotected structure 1 is assembled; and at the same time, two components A and B are injected by means of a dual-nozzle gun, A being a mineral cellular foam to which have been added an anti-corrosion agent and adhesion pigments, and optionally fire retardants, a thermal insulator, an acoustic insulator, etc., and S being a product that causes the cellular foam A to expand, when A and B are in contact with each other.

The expansion of the component A transports the additional agents supported by the foam over all parts of the surfaces 5, even those that are out of sight, and guarantees that they are fully protected.

The cellular foam A thus expanded remains in place after application, so as to cover all the surfaces, thereby rendering the structure 1 impermeable and contributing to its anti-corrosion protection. If required, it is possible to incorporate an impermeable elastic agent into the cellular foam A.

For A and B, it is preferred here to have a product based on two mineral components, which is composed either of a silicone that is ablative, which is transformed by consuming energy, and intumescent, with the formation of a thermally insulating foam, or of mineral components, generally two bases, for example a zinc phosphate and a limestone, such as calcium carbonate. These products also have the benefit of being soluble in water, which makes the rinsing easier and non-polluting. Products such as polyurethane would have the drawback of being inflammable, whereas isocyanates would require solvents for rinsing the tools, which would be environmentally unacceptable.

For example, it is possible to choose a composition from those proposed in document PCT/BE 95.00106, forming a layer of inorganic, adhesive and non-inflammable resin, applied so as to cover the surface to be protected, to be used with an expansion component in a sufficient proportion to obtain an expanded cellular foam that can be expanded in proportions corresponding to the objective sought here.

The mineral compounds used are predominantly made up of combinations of calcium phosphates and carbonates, in particular of plasticizers, such as dibutyl phthalate, dioctyl phthalate, cyclohexyl phthalate or dimethyl glycol phthalate, or those such as butyl benzoate, castor oil, glycerol ricinoleate, methyl ricinoleate, octyl adipate, pentaerythritol or dipropylene glycol heptanoate or butyrate, or else glycerol butyrate or dipropylene glycol butyrate, or camphor.

As regards both plasticizers and fire retardants, it is possible to choose from among tricresyl phosphate, triphenyl phosphate and trichlorethyl phosphate.

Finally, pigments that improve the acoustic insulation may be added.

To reduce the amount of material of the necessary products, it is possible to add a filling material such as hemp or other inexpensive components. The amount of product needed, and therefore its costs, is reduced accordingly.

Environmental trials, especially in salt fog, were carried out on hollow bodies treated according to the method of the invention. The latter, in this case hollow metal bodies, were cut transversely after being exposed to the salt fog for 1000 hours and then 1500 hours so as to allow visual observation of the result obtained. Other trials, with transparent plastic bodies, so as to allow visual observation of the expansion and propagation of the product, showed the effectiveness of the method.

Furthermore, the above means—gun and products A and B—make it possible to produce for much lower cost a metal structure by only carrying out the steps of assembling the structure 1, 2, 3, 4, and then the anti-corrosion S treatment of the difficult-to-access surfaces 5.

Figure 2:
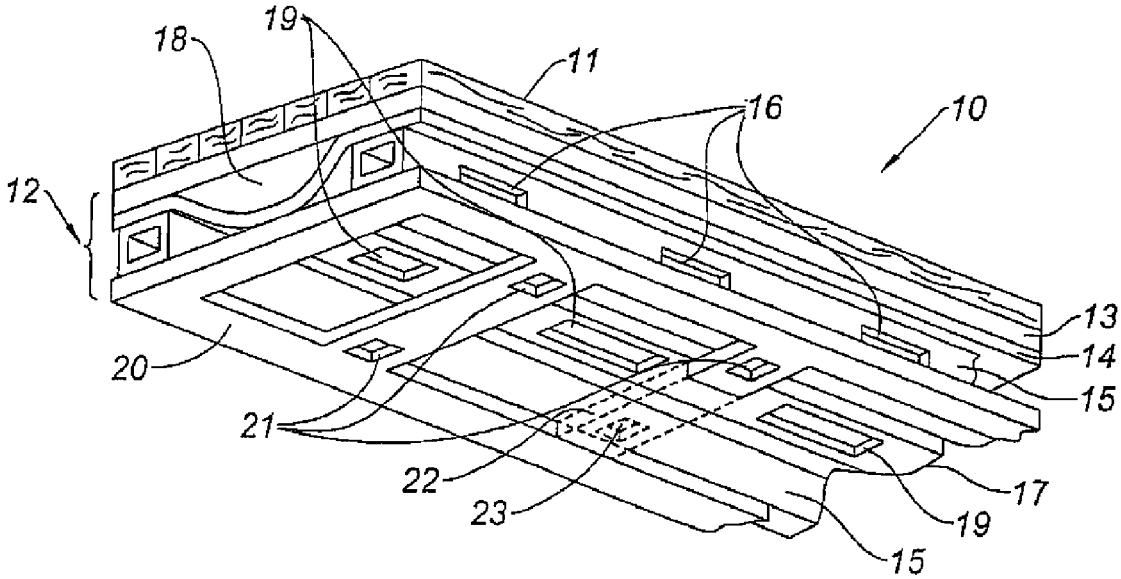
FIG. 2 is a perspective view of a railway wagon floor structure that has a part to be repaired.

These means are particularly suitable, as shown in FIG. 2, for the production and maintenance (also called mid-life operation) of the floor or partition structures 10 of railway wagons.

The example of a structure 10 shown in FIG. 2 comprises here a wooden floor 11 and a metal frame 12 in the likeness of the structure shown in FIG. 1. It comprises metal plates 13 and 20 joined together by natural support beams 15, (however they could also be transverse support beams).

The plate 20 is apertured, having functional openings 21 for various fastenings to be used later. It is stiffened by a reinforcing section 14, 17 fastened to the plate 13.

The support beams here have openings 16 and the reinforcing section 14, 17 has openings 19, facilitating the operations of injecting the foam A into a hollow body 18 having difficult-to-access surfaces to be protected.

Taking merely the example of the floor structure 10, where it is necessary to provide, after manufacture of the structure 10 and before the wooden floor 11 is laid on the metal structure 10, steps for applying an anti-corrosion primer paint, an acoustic coating, strips of rubber and support beams, and rock wool between the support beams, only a single step of injecting the product A, B will now suffice.

It should be pointed out that it is also possible to use the above protection treatment method to protect electrical cables when they pass through the hollow body 18. Cellular foam is used to surround them and thus provide a protective sheath, especially a fire-resistant one.

Since the ordinary maintenance of the wagons has to include regular cleaning operations, it may happen that ingress of water and of detergents resulting from successive cleaning operations can degrade such or such a part 22, as drawn by the dotted lines in FIG. 2, of the metal structure 10 to the point of requiring it to be repaired, for example during what are called mid-life operations.

If the metal structure 10 is constructed according to the above construction process, the damaged part 23 of the part 22 may be cut out using a torch without having to dismantle the wooden floor parts 11, or any inflammable element located nearby, or seats or carpet resting on this floor. This is because the expanded cellular foam A in the hollow body 18, for protecting it, is interposed between the part 23 to be replaced and the floor 11 and, be separating it from the part 23, thermally isolates it and protects it from fire.

Next, all that is therefore required is to manufacture the new part 23 and to weld it to the part 22 and then, once the replacement is complete, to apply the anti-corrosion protection to the new difficult-to-access surfaces of the replaced part 23 using the above protection method. Since the cellular foam acts as a non-inflammable thermal barrier, the part 23 may be replaced directly by welding it, without dismantling the inflammable element 11.

The invention claimed is:

1. A method for maintaining a metal structure, comprising:
replacing a part of the metal structure,
wherein the metal structure comprises
at least one hollow body and
at least one inflammable element;
injecting a cellular foam into the hollow body,
wherein the cellular foam comprises at least one of
an anti-corrosion agent,
a fire retardant, and
a thermal insulator,
wherein the cellular foam is a non-inflammable thermal barrier,
wherein the inflammable element is separated from the part by the cellular foam; and
replacing the part directly without prior removal of the inflammable element.

2. The method according to claim 1, wherein the cellular foam is produced by injectinq a mixture of a first component for the expansion of a second component supporting the anti-corrosion agent and the fire retardant or the thermal insulator.

3. The method according to claim 1, wherein the cellular foam includes at least one pigment.

4. The method according to claim 1, wherein the cellular foam supports an acoustic insulator.

5. The method according to claim 1, wherein the cellular foam supports an impermeable elastic agent.

6. The method according to one of claims 1, wherein the cellular foam includes a filling product.

7. The method according to claim 6, wherein the filling product is hemp.

8. The method of maintenance according to claim 1, wherein said part is flame cut and replaced by another part which is welded to the structure.

* * * * *